US009004747B2

(12) United States Patent
Charbon et al.

(10) Patent No.: US 9,004,747 B2
(45) Date of Patent: Apr. 14, 2015

(54) TIMEPIECE MOVEMENT WITH LOW MAGNETIC SENSITIVITY

(71) Applicant: Nivarox-FAR S.A., Le Locle (CH)

(72) Inventors: Christian Charbon, Chezard-St-Martin (CH); Thierry Hessler, St-Aubin (CH); Jean-Pierre Mignot, Areuse (CH)

(73) Assignee: Nivarox-FAR S.A., Le Locle (CH)

( * ) Notice: Subject to any disclaimer, the term of this patent is extended or adjusted under 35 U.S.C. 154(b) by 90 days.

(21) Appl. No.: 13/720,167

(22) Filed: Dec. 19, 2012

(65) Prior Publication Data

US 2013/0155819 A1 Jun. 20, 2013

(30) Foreign Application Priority Data

Dec. 19, 2011 (EP) ..... 11194286

(51) Int. Cl.

| | |
|---|---|
| ***G04C 5/00*** | (2006.01) |
| ***G04B 17/26*** | (2006.01) |
| ***G04B 43/00*** | (2006.01) |

(52) U.S. Cl.

CPC ..... *G04C 5/005* (2013.01); *G04B 17/26* (2013.01); *G04B 43/007* (2013.01)

(58) Field of Classification Search

CPC ..... G04B 43/00; G04B 43/007; G04B 17/06; G04C 3/04; G04C 3/06; G04C 3/061

USPC ..... 368/126, 293, 175

See application file for complete search history.

(56) References Cited

U.S. PATENT DOCUMENTS

| | | | | |
|---|---|---|---|---|
| 831,561 | A * | 9/1906 | Montgomery | 368/293 |
| 3,002,138 | A * | 9/1961 | Byrnes et al. | 318/132 |
| 3,683,616 | A * | 8/1972 | Steinemann et al. | 368/293 |
| 3,919,836 | A * | 11/1975 | Nishizawa | 368/293 |
| 3,958,410 | A | 5/1976 | Bell | |
| 6,520,674 | B1 * | 2/2003 | Tokoro | 368/127 |
| 6,554,468 | B1 * | 4/2003 | Manaka et al. | 368/127 |
| 6,863,435 | B2 * | 3/2005 | Moteki et al. | 368/140 |
| 2008/0273427 | A1 * | 11/2008 | Zimmermann et al. | 368/293 |
| 2011/0038234 | A1 | 2/2011 | Mignot et al. | |

FOREIGN PATENT DOCUMENTS

| | | |
|---|---|---|
| CH | 348367 | 8/1960 |
| DE | 196 51 320 A1 | 6/1998 |
| EP | 2 287 683 A1 | 2/2011 |

OTHER PUBLICATIONS

European Search Report issued Aug. 13, 2012 in corresponding European Application No. 11 19 4286 filed on Dec. 19, 2011 (with an English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece movement comprising including a sprung balance resonator mounted between a bar and a bottom plate wherein the balance is formed from a ferromagnetic material. The timepiece movement includes a magnetic polarizing device for the balance spring for maintaining a predefined state of polarization in the balance spring and including a permanent magnetizing device which forms a magnetic field in the plane of the balance spring so as to totally or almost totally magnetically saturate the balance spring in the absence of an external magnetic field.

18 Claims, 1 Drawing Sheet

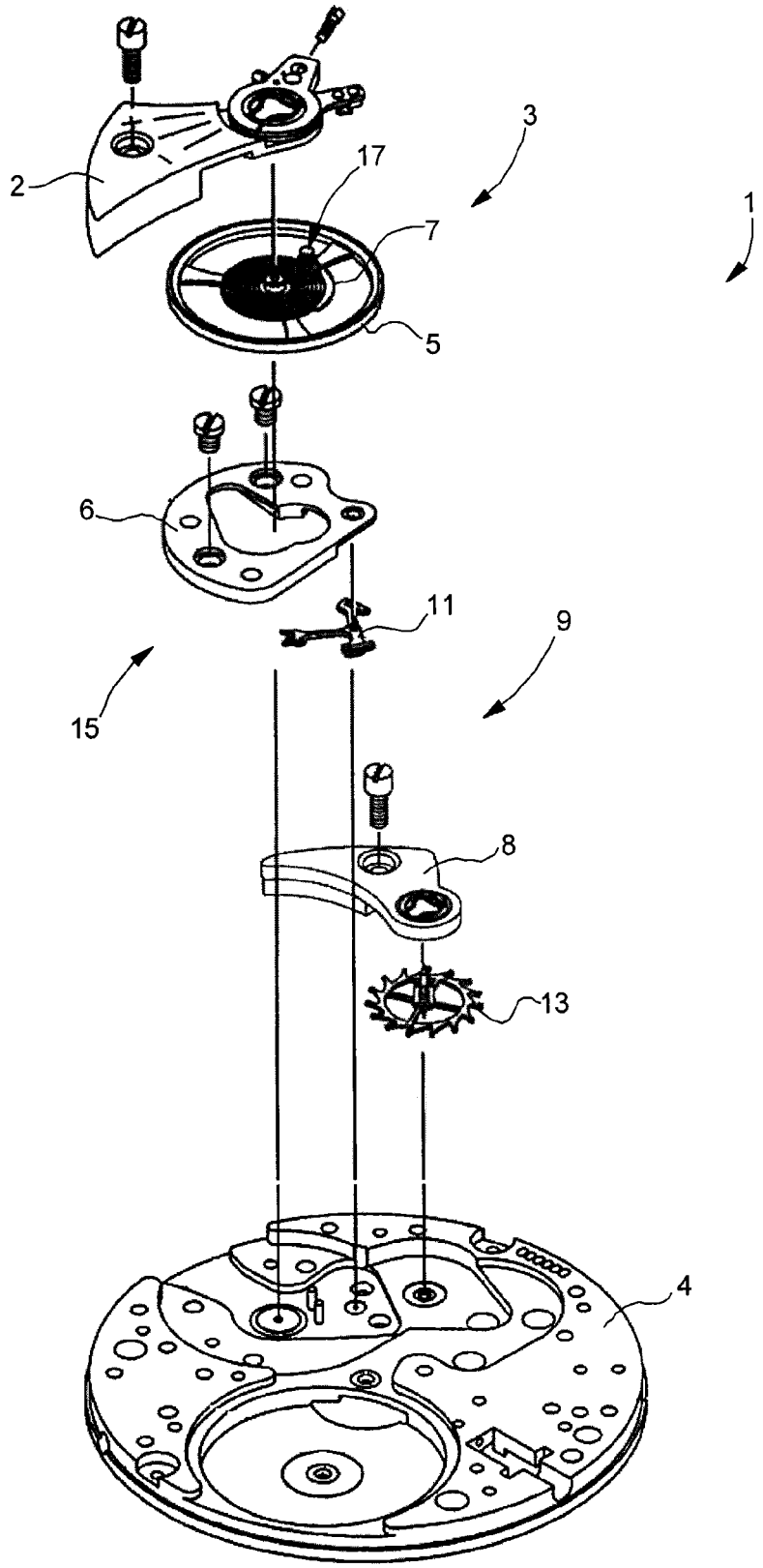
2
17
3
7
1
5
6
11
9
15
8
13
4

TIMEPIECE MOVEMENT WITH LOW MAGNETIC SENSITIVITY

This application claims priority from European Patent Application No. 11194286.8 filed Dec. 19, 2011, the entire disclosure of which is incorporated herein by reference.

FIELD OF THE INVENTION

The invention relates to a timepiece movement with low magnetic sensitivity and more specifically to a movement of this type comprising a sprung balance resonator.

BACKGROUND OF THE INVENTION

In the field of sprung balance resonators, the main defect of the compensating alloys for a current iron-nickel or iron-cobalt based balance spring is their sensitivity to magnetic fields. Thus, a watch which is set perfectly in the absence of a magnetic field may gain or lose several tens of seconds after having been subjected to the influence of an external magnetic field. We are increasingly subject to magnetic radiation in our daily lives.

To overcome these drawbacks, alternative balance springs have been developed based on paramagnetic materials comprising, for example, niobium, or diamagnetic based materials including, for example, silicon. However, these balance springs are very difficult to develop and, incidentally, expensive to produce compared to current iron-nickel or iron-cobalt based balance springs.

SUMMARY OF THE INVENTION

It is an object of the present invention to overcome all or part of the aforementioned drawbacks, by proposing a timepiece movement including a balance spring made of ferromagnetic material which has low sensitivity to external magnetic fields.

The invention therefore relates to a timepiece movement comprising a sprung balance resonator, mounted between a bar and a bottom plate and wherein the balance spring is formed of a ferromagnetic material, characterized in that it includes a magnetic polarisation device for said balance spring intended to maintain a predefined state of polarisation in the balance spring and comprising a permanent magnetising means which forms a magnetic field in the plane of the balance spring so as to almost totally or totally magnetically saturate the balance spring in the absence of any magnetic field external to the movement.

Indeed, advantageously according to the invention, once it has left said interfering magnetic field, the balance spring returns to the nominal polarisation state used when it was set, i.e. it returns to substantially the same frequency as before exposure to an external magnetic field. It is thus clear that the external magnetic field has little influence on the working of the movement and only in the short time period during which the movement is subject to said field.

In accordance with other advantageous features of the invention:

- the field lines of the permanent magnetising means are aligned with the axis of the balance spring wire;
- the permanent magnetising means includes at least one permanent magnet and/or a permanently powered electro-magnet;
- the permanent magnetising means generates a field equal to at least three times the coercive field of the balance spring material;

- the permanent magnetising means generates a field equal to at least 1 mT;
- the magnetic polarising device is secured to a fixed part of the timepiece movement, such as the bar, or to a balance spring stud or the bottom plate;
- the magnetic polarising device is fixed to a moving part of the timepiece movement such as to the balance or balance spring.

Moreover, the invention relates to a timepiece, characterized in that it includes a timepiece movement according to any of the preceding variants.

BRIEF DESCRIPTION OF THE DRAWINGS

Other features and advantages will appear clearly from the following description, given by way of non-limiting illustration, with reference to the FIG. 1, which is a partial view of a timepiece movement according to the invention.

DETAILED DESCRIPTION OF PREFERRED EMBODIMENTS

FIG. 1 shows a partial view of a timepiece movement 1 according to the invention, intended to be mounted in a timepiece. Movement 1 preferably includes a resonator 3 comprising a balance 5 and a balance spring 7 for regulating said movement. Resonator 3 is preferably mounted between a bridge 2 and a bottom plate 4.

FIG. 1 also shows that movement 1 preferably includes an escapement system 9 comprising a Swiss pallet lever 11 and an escape wheel 13 for distributing the motions of said movement. Escapement system 9 is preferably mounted between two bars 6, 8 and bottom plate 4.

Advantageously according to the invention, balance spring 7 is formed from a ferromagnetic material such as Nivarox CT, Elinvar, Ni-Span C or Coelinvar. Thus, although balance spring 7 has a strongly ferromagnetic property, movement 1 according to the invention advantageously has very low magnetic sensitivity.

Indeed, advantageously according to the invention, movement 1 includes a magnetic polarisation device 15 for balance spring 7 for maintaining a predefined state of polarisation in the balance spring to make movement 1 less variable after exposure to an external magnetic field. This is made possible by the fact that magnetic polarising device 15 includes a permanent magnetising means which forms a magnetic field in the plane of balance spring 7 to prevent a variation in the state of polarisation of the balance spring caused by a magnetic field external to timepiece movement 1.

Preferably, the field lines of the magnetising means are aligned with the axis of the wire of balance spring 7 to make magnetisation easier. Moreover, the magnetic field generated by the magnetising means is preferably closed, such as for example by using a mu-metal part, i.e. which has very high magnetic permeability, enabling it to channel the magnetic field lines.

It is thus clear that balance spring 7 is strongly, i.e. almost totally or totally magnetically saturated when movement 1 is set, so that moving into an external magnetic field barely changes or does not change its magnetic features. Thus, in the absence of any external magnetic field, the state of polarisation of balance spring 7 is reproduced by the presence of the magnetising means. It is thus clear that the magnetising means is preferably chosen so that the external magnetic field is not greater than the coercive field of the magnetising means.

Thus, preferably, the permanent magnetising means includes at least one permanent magnet and/or at least one permanently powered electro-magnet to generate a field that is equal to at least three times and preferably four times the coercive field $H_c$ of the material of balance spring 7 but which does not exceed the saturation field thereof. It is thus clear that relative to the materials cited above, the permanent magnetising means preferably generates a field equal to at least 1 mT.

Consequently, polarising device 15 according to the invention does not keep the working of timepiece movement 1 stable when it enters an external magnetic field. However, once it has left said external magnetic field again, balance spring 7 returns to the nominal state of polarisation used when it was set, i.e. it returns to substantially the same frequency as before exposure to an external magnetic field. It is thus clear that the external magnetic field has little influence on the working of movement 1 and only in the short time period during which movement 1 is subject to said field.

According to the invention, magnetic polarising device 15 is fixed to a fixed or moving part of timepiece movement 1. Thus, magnetic polarising device 15 may equally well be fixed to the bar and/or balance spring stud and/or to the bottom plate and/or balance 5 and/or balance spring 7. More particularly, permanent magnetising means 17 may be moved for example onto or into the collet of balance spring 7 and/or onto or into the wire of balance spring 7 and/or onto or into the terminal curve of balance spring 7 as illustrated in FIG. 1.

Of course, this invention is not limited to the illustrated example but is capable of various variants and alterations that will appear to those skilled in the art. In particular, other arrangements of magnetic polarising device 15 may be envisaged. It is also possible to envisage choosing other types of permanent magnetising means.

What is claimed is:

1. A timepiece movement comprising a sprung balance resonator mounted between a bar and a bottom plate and wherein the sprung resonator comprises a balance spring formed from a ferromagnetic material, wherein the timepiece movement further includes a magnetic polarising device for said balance spring for maintaining a predefined state of polarisation in the balance spring and comprising a permanent magnetising means which forms a magnetic field in the plane of the balance spring in order to totally or almost totally magnetically saturate the balance spring in the absence of an external magnetic field, wherein the permanent magnetising means includes at least one permanent magnet.

2. The timepiece movement according to claim 1, wherein the field lines of the permanent magnetising means are aligned with the axis of the balance spring wire.

3. The timepiece movement according to claim 1, wherein the permanent magnetising means generates a field equal to at least three times the coercive field of the balance spring material.

4. The timepiece movement according to claim 1, wherein the permanent magnetising means generates a field equal to at least 1 mT.

5. The timepiece movement according to claim 1, wherein the magnetic polarising device is secured to a fixed part of the timepiece movement.

6. The timepiece movement according to claim 5, wherein the magnetic polarising device is secured to the bar, to a balance spring stud or to the bottom plate of the timepiece movement.

7. The timepiece movement according to claim 1, wherein the magnetic polarising device is secured to a moving part of the timepiece movement.

8. The timepiece movement according to claim 7, wherein said magnetic polarising device is secured to the balance or to the balance spring.

9. A timepiece wherein it includes a timepiece movement according to claim 1.

10. A timepiece movement comprising a sprung balance resonator mounted between a bar and a bottom plate and wherein the sprung resonator comprises a balance spring formed from a ferromagnetic material, wherein the timepiece movement further includes a magnetic polarising device for said balance spring for maintaining a predefined state of polarisation in the balance spring and comprising a permanent magnetising means which forms a magnetic field in the plane of the balance spring in order to totally or almost totally magnetically saturate the balance spring in the absence of an external magnetic field, wherein the permanent magnetising means includes at least one permanently powered electro-magnet.

11. The timepiece movement according to claim 10, wherein the field lines of the permanent magnetising means are aligned with the axis of the balance spring wire.

12. The timepiece movement according to claim 10, wherein the permanent magnetising means generates a field equal to at least three times the coercive field of the balance spring material.

13. The timepiece movement according to claim 10, wherein the permanent magnetising means generates a field equal to at least 1 mT.

14. The timepiece movement according to claim 10, wherein the magnetic polarising device is secured to a fixed part of the timepiece movement.

15. The timepiece movement according to claim 14, wherein the magnetic polarising device is secured to the bar, to a balance spring stud or to the bottom plate of the timepiece movement.

16. The timepiece movement according to claim 10, wherein the magnetic polarising device is secured to a moving part of the timepiece movement.

17. The timepiece movement according to claim 16, wherein said magnetic polarising device is secured to the balance or to the balance spring.

18. A timepiece wherein it includes a timepiece movement according to claim 10.

* * * * *